US006290492B1

(12) United States Patent
Li et al.

(10) Patent No.: US 6,290,492 B1
(45) Date of Patent: Sep. 18, 2001

(54) METHOD OF REDUCING NOX EMISSION FROM MULTI-ZONE REHEAT FURNACES

(75) Inventors: Xianming Li, Orefield; Diwakar Garg, Emmaus, both of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/503,146

(22) Filed: Feb. 15, 2000

(51) Int. Cl.[7] ..... F27B 15/00

(52) U.S. Cl. ..... 432/14; 432/17; 432/19; 432/133

(58) Field of Search ..... 432/14, 17, 19, 432/128, 133

(56) References Cited

U.S. PATENT DOCUMENTS

| | | |
|---|---|---|
| 4,988,285 | 1/1991 | Delano . |
| 5,203,859 | 4/1993 | Khinkis et al. . |
| 5,569,312 | 10/1996 | Quirk et al. . |
| 5,573,568 | 11/1996 | Quirk et al. . |
| 5,683,238 | 11/1997 | Snyder . |
| 5,755,818 | 5/1998 | Tuson et al. . |
| 5,756,059 | 5/1998 | Zamansky et al. . |
| 5,849,059 | 12/1998 | Quirk et al. . |
| 5,851,256 | 12/1998 | Quirk et al. . |
| 5,924,858 | 7/1999 | Tuson et al. . |
| 6,007,326 | 12/1999 | Ryan, III et al. . |

FOREIGN PATENT DOCUMENTS

WO 99/06765 12/1999 (WO) .

OTHER PUBLICATIONS

L. J. Burfield et al., "Oxygen Enrichment of Continuous Reheat Furnaces to Increase Productivity and Reduce Fuel Consumption", 6 pages.

M. Franke, "Cascade Heating System Reduces NOx", Glass, Apr. 1993 pp. 141–142.

Q. Nguyen et al., "Advanced Steel Reheat Furnaces Research and Development", Jan. 14, 1999.

D. Rue et al., "Demonstration of Oxygen–Enriched Air Staging at Owens–Brockway Glass Containers", Gas Research Institute, Oct. 1997.

*Primary Examiner*—Jiping Lu
(74) *Attorney, Agent, or Firm*—Willard Jones, II

(57) ABSTRACT

A method for controlling NOx in a multi-zone re-heating furnace used for meeting process heating (or re-heating) requirements in the metals industry. Oxidant-fuel stoichiometry is altered in different zones of a multi-zone re-heating furnace to reduce the overall NOx emission without replacing existing burners or intrusively modifying the furnace (or drilling holes in the furnace) for fuel and/or an oxidant injection. The oxidant-fuel stoichiometry in at least one zone of a multi-zone re-heating furnace is made either oxidant neutral or oxidant deficient (or fuel rich) to reduce the formation of NOx and the oxidant-fuel stoichiometry of at least one other zone that is located downstream of the oxidant neutral or oxidant deficient zone is made oxidant rich (or fuel lean) to further reduce the formation of NOx in the furnace.

15 Claims, 1 Drawing Sheet

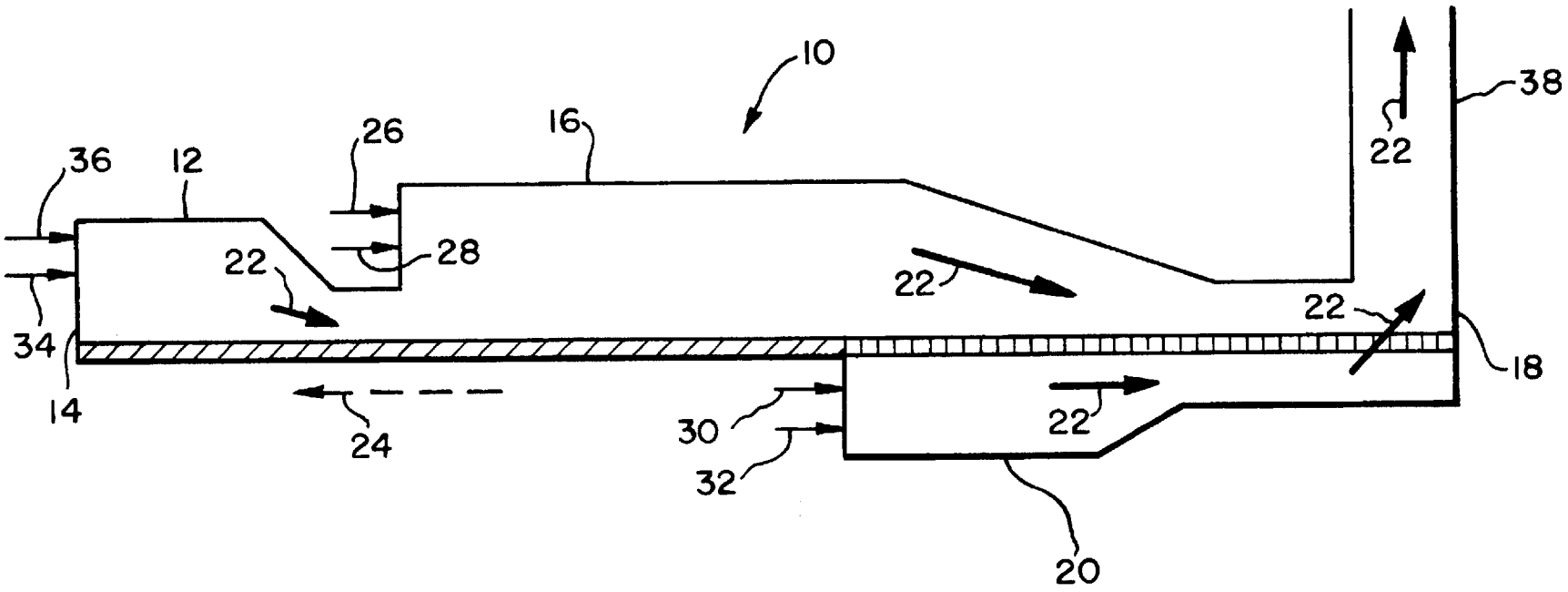
38
22
22
18
22
22
20
10
30
32
16
28
26
24
22
12
36
34
14

METHOD OF REDUCING NOX EMISSION FROM MULTI-ZONE REHEAT FURNACES

CROSS REFERENCE TO RELATED APPLICATIONS

Not Applicable

STATEMENT REGARDING FEDERALLY SPONSORED RESEARCH OR DEVELOPMENT

Not applicable

BACKGROUND OF THE INVENTION

Multi-zone furnaces are widely used in the metals industry, (e.g. copper and steel industries) to meet process heating (or re-heating) requirements. For example, a multiple zone reheat furnace is used in the copper and steel industries to reheat copper and steel billets and ingots for further processing. Typically, a continuous reheat furnace with two or more zones is employed in the steel industry to ensure not only the even distribution of heat, but also the precise control of temperature. These furnaces consume an enormous amount of energy, ranging from 20 to 400 million BTU per hour. Emissions in the form of NOx associated with such enormous use of energy in these furnaces has a profound impact both on the environment and the cost competitiveness of the user. Because of the serious impact on the environment, these industries have been faced with a challenge, namely, reducing the overall emission of NOx to the environment while controlling the operating cost at the same time, to remain competitive in a Global market.

Numerous approaches have been tried in the metals and other industries such as the glass and power generation industries to control and/or reduce the generation and/or emission of NOx. These approaches can be classified into three separate and broad categories: pretreatment, combustion modification, and post-treatment, as described by C. E. Baukal author of Pollutant Emissions, Chapter 3, *Oxygen-Enhanced Combustion*, CRC Press, 1998. Numerous pretreatment approaches such as switching fuel, changing oxidizer, using fuel additives, treating fuel, etc. have been tried to control and/or reduce the generation and/or emission of NOx with some or limited success. Likewise, numerous post-treatment approaches (generally aimed at removing NOx present in the combustion flue gas with scrubbing or chemical treatment) have been developed and commercially used these days by the power generation and chemical process industries. For example, NOx reduction approaches based on injecting ammonia or urea such as selective non-catalytic reduction (SNCR) and selective catalytic reduction (SCR) have been successfully developed and employed by the power generation industry to treat flue gases from very large furnaces or power plants. These post treatment approaches are not only very capital intensive, but they also significantly increase operating costs. They are, therefore, not suitable or not economical to treat flue gases from small to medium size furnaces. Consequently, they are not widely employed for controlling NOx emission from multi-zone reheat furnaces employed by the copper and steel industries. Finally, numerous combustion modification approaches have been developed to implement changes that interrupt the process of NOx formation. Some of these approaches include flue gas recirculation, staged or pulsed combustion of fuel, and advanced mixing. Among the above three broad categories, the combustion modification approaches appear to be most promising and economically attractive to control or reduce NOx emission from small to medium size furnaces.

A number of combustion modification approaches known in the literature can be used to reduce NOx emission from reheat furnaces. For example, a gas reburn approach described in U.S. Pat. No. 5,756,059 can be applied to control NOx emission from a continuous reheat furnace, though it has not yet been used to control NOx from reheat furnaces. According to this patent, NOx emission from a multi-zone continuous steel reheat furnace can be controlled by removing a portion of fuel from one or more combustion zones and injecting it downstream of the combustion zones using an array of specially designed nozzles. The NOx formed in the combustion zones is reacted with the fuel injected downstream of the combustion zones, thereby reducing the overall level of NOx in the flue gas. However, this process results in increasing the level of carbon monoxide in the flue gas. Additional air or oxidant is, therefore, injected using specially designed nozzles to react with carbon monoxide before sending the flue gas out of the furnace to a heat recuperator. Although the reburn approach is technically sound in order to control NOx emission from continuous reheat furnaces, it is very difficult to implement in a retrofit furnace environment. It requires drilling multiple holes in existing reheat furnaces to inject fuel and oxidant, a furnace modification that is neither desirable nor acceptable to operators of reheat furnaces.

Another combustion modification approach that can be used to reduce NOx emission from continuous re-heating furnaces has been described in U.S. Pat. No. 5,203,859. Although the patent describes a process for reducing NOx emission from a glass melter, it can be adapted to a continuous reheat furnace. According to this patent, the stoichiometry of oxygen-enriched combustion in the primary combustion zone (or re-heating zone) is modified to make it fuel rich, thereby reducing the generation of NOx in the primary combustion zone. An additional oxygen-enriched air stream is injected through an array of nozzles downstream of the primary combustion zone (or re-heating zone) to combust the remaining fuel and CO produced in the primary combustion zone. Once again, the process disclosed in this patent is technically sound for control of NOx emission from continuous reheat furnaces. However, it is very difficult to implement this technique in a commercial metal treating furnace. Again the furnace operator must drill multiple holes in the existing reheat furnaces to inject air or oxygen-enriched air. Such furnace modifications are neither desirable nor acceptable to operators of reheat furnaces.

Other combustion modification approaches that can be used to reduce NOx emission from continuous re-heating furnaces are described in U.S. Pat. Nos. 5,569,312, 5,573,568, 5,849,059, and 5,851,256. Although these patents describe a process for reducing NOx in a regenerative glass melter, it can be adapted to a continuous reheat furnace. According to these patents, the treatment to reduce NOx is carried out completely outside the furnace. Specifically, fuel is injected at the entrance of the regenerator located outside the furnace to react with NOx formed in the furnace. The un-reacted fuel and carbon monoxide thus produced is reacted with air that is injected further downstream in the regenerator. The processes disclosed in these patents, therefore, require drilling arrays of holes in the regenerator to inject fuel and air, a modification of the regenerator that is neither desirable nor acceptable to operators of reheat furnaces.

One can incorporate various combustion modification approaches and come up with new burners (low NOx burners) that will by itself produce low NOx. In order to use these low NOx burners, one needs to remove all existing burners and replace them with new low NOx burners. Since reheat furnaces typically use more than 20 burners, replacing old burners with new low NOx burners requires substantial capital investment which is neither desirable nor acceptable to operators of reheat furnaces.

Based on the above discussion, it is clear that a number of technologies are currently available to control NOx emission from a multi-zone furnaces provided one is willing to intrusively modify such furnaces (or drilling holes in furnaces) for fuel and/or air injection, or invest significant amounts of money to replace old burners with new low NOx burners. Therefore, there is a need to develop a method for control of NOx emission from multi-zone furnaces without replacing burners or intrusively modifying such furnaces for additional fuel and/or oxidant injection and that is simple to implement.

SUMMARY OF THE INVENTION

The present invention is an improved method for controlling NOx in a multi-zone furnace used for meeting process heating requirements of the metals industry (e.g. the copper and steel industries). According to the method, the oxidant-fuel stoichiometry has been altered in different zones of a multi-zone furnace to reduce the overall NOx emission without replacing existing burners, modifying the furnace, or drilling holes in the furnace for fuel and/or oxidant injection. As used herein the term multi-zone furnace refers to a furnace with one or more heating zones and at least one soaking zone. In a re-heating furnace the heating zones are often referred to as re-heating zones. The soak zone permits the material being heated to equalize at the desired temperature prior to the next operation. Specifically, the oxidant-fuel stoichiometry in at least one zone of a multi-zone furnace is made oxidant neutral or oxidant deficient (or fuel rich) to reduce the formation of NOx and the oxidant to fuel stoichiometry of at least one other zone that is located downstream of the oxidant neutral or deficient zone is made oxidant rich (or fuel lean) to further reduce the formation of NOx in the furnace. Key features of the present invention are (1) that the flue gases from the oxidant neutral or deficient (or fuel rich) and the oxidant rich (or fuel lean) zones are mixed either in the multi-zone furnace or in the flue duct at high temperature to allow complete remedy of the CO and any un-reacted fuel that might be present in the flue gases from the oxidant neutral or deficient (or fuel rich) zone with excess oxidant present in the flue gases from the oxidant rich (or fuel lean) zone and (2) that the overall oxidant-fuel stoichiometry used in the furnace is oxidant rich to avoid emission of undesirable carbon monoxide.

Therefore in one aspect the present invention is a method for controlling formation of NOx in a metal heating furnace having a soak zone and at least two heating zones wherein metal to be heated moves from the heating zones to the soak zone counter-current to combustion gases flowing through the furnace to a flue in the furnace, the heating effected by combustion of fuel and an oxidant, comprising the steps of: operating at least one heating zone of the furnace so that the zone is one of oxygen neutral or fuel rich as determined by stoichiometry; operating at least one other heating zone of the furnace downstream of the one heating zone of the furnace oxidant rich as determined by stoichiometry; and maintaining the overall oxidant-fuel stoichiometry in the furnace oxidant rich, whereby flue gases from the one zone and the one other zone are mixed prior to exiting the flue, whereby NOx and CO formation in the flue gases exiting the flue are suppressed.

In another aspect the present invention is a method for controlling formation of NOx in a metal heating furnace having a soak zone and at least one heating zone and wherein the metal to be heated moves through the heating zone then through the soak zone counter-current to combustion gases flowing through the furnace to a flue in the furnace, the heating effected by combustion of fuel with an oxidant, comprising the steps of: operating the furnace so that the heating zone is oxidant-rich or fuel-lean as determined by stoichiometry; operating the soak zone of the furnace so that the soak zone is oxygen deficient or fuel rich as determined by stoichiometry; and maintaining the overall oxidant-fuel stoichiometry in the furnace oxidant rich, whereby flue gases from the soak zone and the heating zone mixed in one of the furnace or the flue, whereby NOx and CO formation in the flue gases exiting said flue are suppressed.

BRIEF DESCRIPTION OF THE DRAWINGS

FIG. 1 is a schematic representation of a three-zone continuous furnace used for re-heating steel billets.

DETAILED DESCRIPTION OF THE INVENTION

Multi-zone furnaces are widely used in the copper and steel industries to meet process heating (or re-heating) requirements. For example, a multiple zone reheat furnace is used in the copper and steel industries to reheat copper and steel billets and ingots for further processing. Typically, a continuous reheat furnace with two or more zones is employed in the steel industry to ensure not only the even distribution of heat, but also the precise control of temperature. These furnaces consume an enormous amount of energy, ranging from 20 to 400 million BTU per hour. The emission in the form of NOx associated with such enormous use of energy in these furnaces has a profound impact both on the environment and the cost competitiveness of these industries. Because of enormous impact on environment, these industries have been faced with a challenge of reducing the overall emission of NOx to the environment while controlling the operating cost at the same time to remain competitive in the Global market place.

Although the method disclosed in the present invention is suitable for controlling NOx from reheat furnaces used by metal producers in general, it is ideally suited for reheat furnaces used in the steel industry. Steel reheat furnaces account for almost 30% of the total NOx emission generated by the steel industry. These furnaces are employed to reheat steel billets, ingots, slabs, etc. to between 2,000 and 2,300° F. to facilitate further processing, for example rolling steel slabs to make flat rolled product. The product (for example steel slab) moves countercurrent to flue gas in a continuous steel reheat furnace. A typical furnace consists of two or more zones. For example, an entrance zone for re-heating the product followed by a soak zone for normalizing the temperature of the product is typically employed in a two-zone continuous reheat furnace. Likewise, a furnace with an entrance section for re-heating the product both from the top and bottom followed by a soak zone for normalizing the temperature of the product is typically employed in a three-zone continuous reheat furnace. The flue gas exiting either from a two-zone or a three-zone furnace is mixed within the furnace or in the flue duct and then passed through a recuperator to recover heat by pre-heating the oxidant. These furnaces utilize a variety of fuels including natural gas, propane, coke oven gas, town gas, fuel oil, etc. to provide heat inputs ranging from 20 to 400 million BTU per hour.

The improved method according to the present invention is suitable for a two-zone furnace as well as a furnace with more than two zones. A furnace with two zones may have a re-heating zone and a soak zone to heat the material. In this case, the soak zone will be operated fuel rich (oxygen-deficient) and the re-heating zone fuel-lean (oxygen-rich) to reduce overall emission of NOx. The flue gases both from the soak zone and reheat zones are mixed either in the furnace or in the flue duct at high temperature to completely remedy the CO and any un-reacted fuel that might be present in the flue gases from the oxidant deficient (or fuel rich) zone with excess oxidant present in the flue gases from the oxidant rich (fuel-lean) zone. Likewise, a multi-zone furnace may have a soak zone and a number of heating zones. In this case, the normal operation of the soak zone is not altered, but the operation of re-heating zones is altered to meet the requirements of the present invention. The operation of a three-zone furnace is described in detail below to illustrate one aspect of the method of the present invention.

The schematic representation of a typical three zone continuous steel reheat furnace is shown generally as 10 in FIG. 1. The furnace 10 consists of three-zones, a soak zone 12 located at the exit end 14 of the furnace 10, an upper heating zone 16 located toward the entrance end 18 of the furnace 10, and a lower heating zone 20 also located at the entrance end 18 of the furnace 10. The steel product that needs to be reheated enters the furnace from the entrance end 18 of the furnace 10, heated and normalized, and discharged from the exit end of the furnace. The combustion flue gases represented by arrows 22 move countercurrent to the movement of steel, represented by arrow 24, being reheated. In the soak zone 12, a fuel-oxidant mixture is fired through a number of burners represented by arrows 34, 36 at neutral or slightly oxidant rich (or fuel lean) stoichiometry. The neutral stoichiometry is defined here as the amount of oxidant present in the fuel-oxidant mixture is just enough for the oxidant to convert (or combust) fuel completely to a mixture of carbon dioxide and water. The neutral oxidant-fuel stoichiometry is represented by a stoichiometry of 1.0. An oxidant rich (or fuel lean) oxidant-fuel mixture is defined as a mixture in which the amount of oxidant present in the oxidant-fuel mixture is more than the amount required for the complete combustion of fuel to a mixture of carbon dioxide and water. An oxidant rich mixture has a stoichiometry which is always more than 1. For example, a stoichiometry 1.05 means that the fuel-oxidant mixture is 5% rich in oxidant. Likewise, an oxidant deficient (or fuel rich) mixture is defined as a mixture in which the amount of oxidant present in the oxidant-fuel mixture is less than the amount required for the complete combustion of fuel to a mixture of carbon dioxide and water. An oxidant deficient mixture has a stoichiometry which is always less than 1. For example, a stoichiometry 0.95 means that the fuel oxidant mixture is 5% deficient in oxidant.

The flue gases from the soak zone 12 flow into the next zone or upper 16 and lower 20 heating zones of the furnace 10. From the product being heated point of view, immediately upstream of the soak zones, the steel product is rapidly heated to the desired temperature or rolling temperature by firing an oxidant-fuel mixture through a number of burners (26, 28, 30, 32) located in the upper 16 and lower 20 heating zones respectively of furnace 10. These burners (26, 28, 30, 32) are conventionally fired under oxidant rich stoichiometry to minimize release of CO and/or un-combusted fuel to the environment. The flue gases 22 from the upper 16 and lower 20 heating zones are mixed through gaps on the sides of the furnace 10, through small openings in the support mechanism such as walking beam, and through large openings known "ears" close to the entrance 18 of the product to be reheated in furnace 10 but prior to flue gases 22 exiting the furnace 10 through flue 38. Although not shown in FIG. 1, the combustion flue gases 22 exiting the furnace 10 flow through a recuperator (a heat recovery device) to recover a part of the energy by preheating combustion oxidant.

Surprisingly we have found that the overall NOx emission from a three-zone continuous reheat furnace can be reduced dramatically without replacing existing burners or extensively modifying the furnace for fuel and/or oxidant injection by (1) operating the burners located in the upper heating zone in oxidant neutral or deficient (or fuel rich) mode to suppress the formation of NOx and (2) operating the burners located in the lower heating zone in oxidant rich (or fuel lean) mode to reduce flame temperature and further suppress the formation of NOx. The key features of the method according to the invention are (1) that the flue gases from the oxidant neutral or deficient (or fuel rich) and the oxidant rich (or fuel lean) zones are mixed either in the multi-zone furnace or in the flue duct at high temperature to allow complete remedy of the CO and any un-reacted fuel that might be present in the flue gases from the oxidant neutral or deficient (or fuel rich) zone with excess oxidant present in the flue gases from the oxidant rich (or fuel lean) zone and (2) that the overall oxidant-fuel stoichiometry used in the furnace is oxidant rich to avoid emission of undesirable carbon monoxide.

The use of an oxidant neutral or oxidant deficient oxidant-fuel mixture in the burners located in the upper heating zone results in suppressing the formation of NOx but at the expense of forming undesirable CO pollutant. This phenomenon is well known in the literature as the fuel rich combustion operation, but it is not commonly practiced due to resultant CO emission. The use of oxidant rich oxidant-fuel mixture in the burners located in the lower heating zone results in lowering the flame temperature and suppressing the formation of NOx. This phenomenon is also well known in the literature as the fuel lean combustion operation, and it is commonly practiced to control the NOx formation. The flue gases from the upper heating zone that might be rich in CO and unconverted fuel and those from the lower heating zone that are oxidant rich are mixed either in the furnace or in the flue duct at high temperature to remedy the CO and un-reacted fuel, thereby eliminating any potential of emission by CO and un-reacted fuel. It should be noted that operation of burners located in the soak zone are not altered to reduce NOx formation because it is critical to maintain a desired temperature profile for the product and also because the amount of fuel used in the soak zone is only a small portion of the total fuel used in the furnace. They can, however, be operated under oxidant neutral to slightly oxidant rich (fuel lean) conditions.

Therefore, according to the method of the present invention, the oxidant-fuel stoichiometry has been altered in different zones of a multi-zone furnace to reduce the overall NOx emission without replacing existing burners or modifying the furnace for fuel and/or oxidant injection. Specifically, the oxidant-fuel stoichiometry in at least one zone of a multi-zone furnace is made oxygen neutral or deficient (or fuel rich) to reduce the formation of NOx and the oxidant-fuel stoichiometry of at least one other zone that is located downstream of the oxidant neutral or deficient zone is made oxidant rich (or fuel lean) to further reduce the formation of NOx in the furnace. The key features of the present invention are that the flue gases from the oxidant neutral or deficient (or fuel rich) and the oxidant rich (or fuel lean) zones being mixed either in the multi-zone furnace or in the flue duct at high temperature to allow complete suppression of CO formation and any un-reacted fuel that might be present in the flue gases from the oxidant neutral or deficient (or fuel rich) zone with excess oxidant present in the flue gases from the oxidant rich (or fuel lean) zone and the overall oxidant-fuel stoichiometry used in the furnace being oxidant rich to avoid emission of undesirable carbon monoxide are achieved.

The oxidant-fuel stoichiometry used in the zone with oxidant general or oxidant deficient operation, according to the method of present invention, can be selected to vary from about 1.0 to 0.75, preferably from about 1.0 to 0.85, more preferably from about 1.0 to 0.95. The overall firing rate in this zone can vary from about 2 to 200 million BTU per hour.

The oxidant-fuel stoichiometry used in the zone with oxidant rich operation can be selected to vary from about 1.0 to 1.4, preferably from about 1.0 to 1.3, more preferably from about 1.0 to 1.2. The overall firing rate in this zone can vary from about 2 to 200 million BTU per hour.

The oxidant-fuel stoichiometry used in the soak zone of a furnace with more than two re-heating zones is maintained the same as conventionally used by the industry. It can, as mentioned before, be selected from being oxidant neutral to slightly oxidant rich. More specifically, it can be selected to vary from about 1.0 to 1.15, preferably from about 1.0 to 1.10, more preferably from about 1.0 to 1.05. The overall firing rate in this zone can vary from about 2 to 50 million BTU per hour.

The fuel used for providing heat into the furnace, according to the present invention, can be selected from natural gas, liquefied natural gas (LNG), propane, liquefied petroleum gas (LPG), coke oven gas, town gas, is and fuel oil such as No. 2 or No. 6 fuel oils.

The oxidant used for sustaining combustion can be selected from air, oxygen-enriched air with an oxygen level varying from greater than 21% by volume to less than 99% by volume, and pure oxygen. The oxygen-enriched air can be produced either by blending oxygen with air or directly by using a non-cryogenic generation technique such as vacuum swing adsorption. The oxygen used for combustion can be generated by either a cryogenic or a non-cryogenic generation technique, both techniques being well known methods.

It is important that the gases from different zones of a multi-zone furnace, according to the method of present invention, are mixed either in the furnace or in the flue duct at high temperature prior to entering the recuperator. It is also important that the flue gases from the furnace are mixed at a temperature above about 1,200° F., preferably above about 1,400° F., and more preferably above about 1,600° F. to facilitate the interaction between CO, un-reacted fuel and oxygen to eliminate any potential of emission by CO and un-reacted fuel. In addition, it is important that the overall oxidant-fuel stoichiometry used in the furnace is oxidant rich to avoid emission of undesirable carbon monoxide from the furnace to the environment.

The following examples further illustrate the present invention.

EXAMPLE 1

In order to demonstrate the invention, the operation of a three zone continuous walking beam type reheat furnace similar to the one shown in FIG. 1 was simulated to establish the baseline data using a software package sold under the name Fluent by Fluent, Inc. of Lebanon, N.H. The software is capable of modeling fluid flow and heat transfer along with combustion reactions. The reheat furnace, set to be 65 feet long and 30 feet wide and used to reheat steel billets, had three zones—a soak zone, an upper heating zone, and a lower heating zone. The furnace had a design heating capacity of 115 tons per hour of steel billets to a discharge temperature of 2,150° F. The furnace consumed on the average 126 million BTU per hour (MMBTU/hr)of energy that was supplied by firing natural gas as a fuel with air as an oxidant. Approximately 25 MMBTU/hr of the total energy was supplied into the soak zone 12, 61 MMBTU/hr into the upper heating zone 16, and the remaining 40 MMBTU/hr into the lower heating zone 20 of the furnace 10. The overall oxidant-fuel stoichiometry used in the furnace was 1.1, indicating that the normal operation of the reheat furnace was oxidant rich (or fuel lean). The oxidant-fuel stoichiometry of individual zones was also 1.1, indicating that they were also operated in oxidant rich (or fuel lean) mode. The prime reason of operating the furnace under oxidant rich (or fuel lean) mode was to keep the emission of CO and un-combusted fuel low. The air used as an oxidant was preheated to a temperature of approximately 1,000° F. by passing it through a recuperator, not shown in the drawing figure. The hot flue gases from the furnace 10 were passed through the recuperator to recover heat by preheating combustion air. The hot flue gases exited the furnace or entered the recuperator at a temperature of about 1,670° F. The combustion gases from all three zones of this furnace were mixed prior to exiting the furnace and entering the recuperator.

The detailed material and energy balance calculated via the Fluent computational fluid dynamics software showed that the NOx emission from the furnace under the baseline operating condition was close to 1.5 pounds per million BTU of heat input or a total NOx emission of close to 189 pounds per hour. Please note that the NOx emission value reported here is in terms of NO, nitric oxide, present in the flue gas. The flue gas temperature exiting the furnace was found to be about 1,670° F. There was, as expected, an insignificant amount of CO or un-combusted fuel present in the flue gas.

EXAMPLE 2

The operation of the three zone continuous walking beam type reheat furnace described in Example 1 was modified in an attempt to reduce the overall level of NOx emission from the furnace. Specifically, no changes were made in the operation or firing rate of the soak zone. It was continued to be operated with 1.1 oxidant-fuel stoichiometry with 25 MMBTU/hr heat input. The operation of the upper heating zone was modified by injecting 10% additional fuel without changing the flow rate of the oxidant. This amounted to injecting an equivalent of about 6.1 MMBTU/hr of additional energy into the upper zone. No changes were made in the operation or firing rate of the lower heating zone. It was continued to be operated with 1.1 oxidant-fuel stoichiometry with a firing rate of about 40 MMBTU/hr. Consequently, the new energy input to the soak, upper heating, and lower heating zones was 25, 67.1, and 40 MMBTU/hr, respectively. The above modifications meant that the upper heating zone was fired with 1.0 oxidant-fuel stoichiometry. The overall oxidant fuel stoichiometry in the furnace was close to 1.045 (4.5% excess oxidant).

The detailed material and energy balance calculated via the Fluent computational fluid dynamics software showed that the average flue gas temperature increased slightly to about 1,690° F. from the baseline value of 1,670° F. More importantly, however, the NOx emission from the furnace increased to about 1.58 pounds per million BTU of heat input, representing a 5.7% increase in NOx emission from the baseline value. The total level of NOx emission increased to about 209 pounds per hour, representing a 10.4% increase in NOx emission from the baseline value. There was insignificant amount of CO or un-combusted fuel present in the flue gas.

This example, therefore, showed that the NOx emission from a multi-zone furnace can not be reduced simply by modifying the oxidant-fuel stoichiometry in only one heating zone.

EXAMPLE 3

The operation of the three zone continuous walking beam type reheat furnace described in Example 1 was modified once again in an attempt to reduce the overall level of NOx emission from the furnace. Specifically, no changes were made in the operation or firing rate of the soak zone. It was continued to be operated with 1.1 oxidant-fuel stoichiometry with 25 MMBTU/hr heat input. The operation of the upper heating zone was modified by injecting 15% additional fuel without changing the flow rate of the oxidant. This amounted to injecting an equivalent of about 9.15 MMBTU/hr of additional energy into the upper zone. No changes were made in the operation or firing rate of the lower heating zone. It was continued to be operated with 1.1 oxidant-fuel stoichiometry with a firing rate of about 40 MMBTU/hr. Consequently, the new energy input to the soak, upper heating, and lower heating zones was 25, 70.15, and 40 MMBTU/hr, respectively. The above modifications meant that the upper heating zone was fired with 0.956 oxidant-fuel stoichiometry (slightly fuel rich). The overall oxidant fuel stoichiometry in the furnace was close to 1.026 (2.6% excess oxidant).

The detailed material and energy balance calculated via the Fluent computational fluid dynamics software showed that the average flue gas temperature increased to about 1,730° F. from a baseline value of 1,670° F. The NOx emission from the furnace decreased to about 0.94 pounds per million BTU of heat input, representing a 37.3% reduction in NOx emission from the baseline value. The total level of NOx emission decreased to about 127 pounds per hour, representing a 32.8% decrease in NOx emission from the baseline value. More importantly, however, there was an undesirable increase in the amount of CO present in the flue gas. This increase in the amount of CO in the flue gas was probably related to operating the furnace very close to neutral oxidant-fuel stoichiometry.

This example, therefore, showed that the NOx emission from a multi-zone furnace can be reduced simply by modifying the oxidant-fuel stoichiometry in only one heating zone, but at the expense of increasing CO emission.

EXAMPLE 4

The operation of the three zone continuous walking beam type reheat furnace described in Example 1 was modified to reduce the overall level of NOx emission from the furnace. Specifically, no changes were made in the operation or firing rate of the soak zone. It was continued to be operated with 1.1 oxidant-fuel stoichiometry with 25 MMBTU/hr heat input. The operation of the upper heating zone was modified by injecting 10% additional fuel without changing the flow rate of the oxidant. This amounted to injecting an equivalent of about 6.1 MMBTU/hr of additional energy into the upper zone. The firing rate in the lower heating zone was maintained to be the same as in Control Example 1 which was about 40 MMBTU/hr. Consequently, the new energy input to the soak, upper heating, and lower heating zones was 25, 67.1, and 40 MMBTU/hr, respectively. The oxidant-fuel stoichiometry in the lower heating zone was increased from 1.1 (10% excess oxidant as used in the Control Example 1) to 1.268 (26.8% excess oxidant) to maintain the overall 1.1 oxidant-fuel stoichiometry in the furnace. The above modifications meant that the upper heating zone was fired with 1.0 oxidant-fuel stoichiometry and the lower heating zone was fired in substantially oxidant rich (or fuel lean) mode.

The detailed material and energy balance calculated via the Fluent computational fluid dynamics software showed that the average flue gas temperature increased slightly to about 1,700° F. More importantly, however, the NOx emission from the furnace decreased to about 0.82 pounds per million BTU of heat input, representing a 45% reduction in NOx emission from the baseline value. The total level of NOx emission decreased to about 108.3 pounds per hour, representing a 42.7% reduction in NOx emission from the baseline value. There was insignificant amount of CO or un-combusted fuel present in the flue gas.

This example, therefore, showed that the NOx emission from a multi-zone furnace can be greatly reduced by modifying the oxidant-fuel stoichiometry in more than one heating zone.

EXAMPLE 5

The operation of the three zone continuous walking beam type reheat furnace described in Example 1 was modified to reduce the overall level of NOx emission from the furnace. Specifically, no changes were made in the operation or firing rate of the soak zone. It was continued to be operated with 1.1 oxidant-fuel stoichiometry with 25 MMBTU/hr heat input. The operation of the upper heating zone was modified by injecting 15% additional fuel without changing the flow rate of the oxidant. This amounted to injecting an equivalent of about 9.15 MMBTU/hr of additional energy into the upper zone. The firing rate in the lower heating zone was maintained to be the same as in Control Example 1 which was about 40 MMBTU/hr. Consequently, the new energy input to the soak, upper heating, and lower heating zones was 25, 70.15, and 40 MMBTU/hr, respectively. The oxidant-fuel stoichiometry in the lower heating zone was increased from 1.1 (10% excess oxidant as used in the Control Example 1) to 1.351 (35.1% excess oxidant) to maintain the overall 1.1 oxidant-fuel stoichiometry in the furnace. The above modifications meant that the upper heating zone was fired with 0.96 oxidant-fuel stoichiometry (4% fuel rich mode) and the lower heating zone was fired in substantially oxidant rich (or fuel lean) mode.

The detailed material and energy balance calculated via the Fluent computational fluid dynamics software showed that the average flue gas temperature increased slightly to about 1,740° F. More importantly, however, the NOx emission from the furnace decreased to about 0.68 pounds per million BTU of heat input, representing a 54% reduction in NOx emission from the baseline value. The total level of NOx emission decreased to about 91.9 pounds per hour, representing a 51.3% reduction in NOx emission from the baseline value. There was insignificant amount of CO or un-combusted fuel present in the flue gas.

This example, therefore, showed that the NOx emission from a multi-zone furnace can be greatly reduced by modifying the oxidant-fuel stoichiometry in more than one heating zone.

The results in above examples clearly show that the NOx emission from a multi-zone re-heating furnace can not be reduced simply by adding more fuel to one of the heating zones even if the overall stoichiometry of furnace operation is oxidant rich, as described in Control Example 2. The results also show that it is not desirable to operate a re-heating furnace close to an overall stoichiometry of 1.0 to reduce NOx emission, because it results in increasing the emission of undesirable carbon monoxide, as described in Control Example 3. The results clearly show that it is desirable to change stoichiometry of at least two or more zones and maintain an overall oxidant-fuel stoichiometry oxidant rich to reduce NOx emission without increasing emission of undesirable carbon monoxide.

The cost of reducing NOx emission using the method disclosed in the present invention is compared to that of well known processes such as selective non catalytic reduction (SNCR) and selective catalytic reduction (SCR). It is assumed in the comparison that none of the heat input by additional fuel is recovered in the method of the present invention. This means that the additional fuel used becomes an on-going additional operating cost for reducing NOx emission. There are no additional costs in terms of capital involved for reducing NOx with the method of present invention. The relative cost of reducing NOx according to Examples 4 and 5 of the present invention and that for SNCR and SCR are summarized in Table 1 below.

TABLE 1

| NOx reduction Technique | Relative Cost of Reducing NOx* |
|---|---|
| Baseline (Control Example 1) | — |
| Example 4 (Method of Present Invention) | 1.0 |
| Example 5 (Method of Present Invention) | 1.25 |
| SNCR | 4.15 |
| SCR | 5.25 |

*The cost information for SNCR and SCR has been obtained from a report prepared for the Gas Research Institute by the Institute of Gas Technology titled "Demonstration of Oxygen-Enriched Air Staging at Owens-Brockway Glass Containers", GRI-97/0292, October 1997.

The data in Table 1 clearly show that the method of the present invention is very cost effective compared to the known processes such as selective non-catalytic reduction (SNCR) and selective catalytic reduction (SCR).

Having thus described our invention what is desired to be secured by Letters Patent of the United States is set forth in the appended claims which should be read without limitation.

What is claimed:

1. A method for controlling formation of NOx in a metal heating furnace having a soak zone and at least two heating zones wherein metal to be heated moves through said heating zones and through said soak zone counter-current to combustion gases flowing through the furnace to a flue in said furnace, said heating effected by combustion of a fuel with an oxidant, comprising the steps of:

operating at least one heating zone of said furnace so that said zone is one of oxygen neutral or fuel rich as determined by stoichiometry; and operating at least one other heating zone of said furnace downstream of said one zone of said furnace oxidant which as determined by stoichiometry with an increase in oxidant content large enough in said one other heating zone of said furnace to maintain an overall oxidant rich oxidant-fuel stoichiometry in said furnace;

whereby said flue gases from said one heating zone and said one other heating zone are mixed prior to exiting said flue, whereby NOx and CO formation in said flue gases exiting said flue are suppressed.

2. A method according to claim 1, including the step of operating said one zone at a firing rate of from 2 to 200 million BTU/hr.

3. A method according to claim 1, including the step of operating said one heating zone with an oxidant to fuel stoichiometric ratio of from about 1.0 to about 0.75.

4. A method according to claim 1, including the step of operating said furnace wherein said soak zone operates at a firing rate of from 2 to 50 million BTU/hr.

5. A method according to claim 4, including the step of operating said furnace with said soak zone being operated under one of fuel-rich, fuel-lean, or oxidant neutral as determined by stoichiometry.

6. A method according to claim 5, including the step of operating said soak zone with an oxidant to fuel stoichiometric ratio of from about 1 to 1.15.

7. A method according to claim 1, including the step of operating said furnace with said one other zone fired at a rate of from 2 to 200 million BTU/hr.

8. A method according to claim 1, including the step of operating said furnace with said one other zone with an oxidant to fuel stoichiometric ratio of from about 1.0 to 1.4.

9. A method according to claim 1, including selecting said fuel from the group consisting of natural gas, liquefied natural gas, propane, liquefied petroleum gas, coke oven gas, town gas and number 2 or fuel oil.

10. A method according to claim 1, introducing selecting said oxidant from the group consisting of air, pure oxygen, impure oxygen, non-cryogenically produced oxygen, air enriched with oxygen, said air enriched with oxygen containing greater then 21% oxygen by volume to 99% oxygen by volume.

11. A method for controlling formation of NOx in a metal heating furnace having a soak zone and at least one heating zone and wherein the metal to be heated moves through said heating zone then through said soak zone counter-current to combustion gases flowing through said furnace to a flue in said furnace, said heating effected by oxy-fuel combustion, comprising the steps of:

operating said heating zone of said furnace so that said zone is oxygen-rich or fuel-lean as determined by stoichiometry;

operating said soak zone of said furnace so that said soak zone is oxygen deficient or fuel rich as determined by stoichiometry; and increasing the total oxygen content of said oxygen rich zone to maintain an overall oxidant rich oxidant-fuel stoichiometry in said furnace whereby said flue gases from said soak zone and said heating zone mixed prior to entering said flue, whereby NOx and CO formation in said flue gases exiting said flue are suppressed.

12. A method according to claim 11, including the step of operating said heating zone at a firing rate of from 2 to 200 million BTU/hr.

13. A method according to claim 11, including the step of operating said heating zone with an oxidant to fuel stoichiometric ratio of from greater than 1 to about 1.4.

14. A method according to claim 11, including the step of operating said soak zone with an oxidant to fuel stoichiometric ratio of from about 1 to about 0.75.

15. A method according to claim 11, including the step of operating said soak zone at a firing rate of from 2 to 50 million BTU/hr.

* * * * *

UNITED STATES PATENT AND TRADEMARK OFFICE

CERTIFICATE OF CORRECTION

PATENT NO. : 6,290,492 B1
DATED : September 18, 2001
INVENTOR(S) : Li et al.

It is certified that error appears in the above-identified patent and that said Letters Patent is hereby corrected as shown below:

Column 11,
Line 63, delete "which" and substitute therefore -- rich --.

Signed and Sealed this

Twenty-sixth Day of February, 2002

*Attest:*

*Attesting Officer*

JAMES E. ROGAN
*Director of the United States Patent and Trademark Office*